US009039126B2

(12) United States Patent
Hirayama et al.

(10) Patent No.: US 9,039,126 B2
(45) Date of Patent: May 26, 2015

(54) LIQUID EJECTION HEAD SUBSTRATE AND LIQUID EJECTION HEAD

(71) Applicant: CANON KABUSHIKI KAISHA, Tokyo (JP)

(72) Inventors: Nobuyuki Hirayama, Fujisawa (JP); Ryo Kasai, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/231,842

(22) Filed: Apr. 1, 2014

(65) Prior Publication Data

US 2014/0300660 A1 Oct. 9, 2014

(30) Foreign Application Priority Data

Apr. 3, 2013 (JP) ..... 2013-077853

(51) Int. Cl.
*B41J 2/07* (2006.01)
*B41J 2/14* (2006.01)

(52) U.S. Cl.
CPC ..... *B41J 2/072* (2013.01); *B41J 2/1404* (2013.01); *B41J 2/1408* (2013.01); *B41J 2/14153* (2013.01)

(58) Field of Classification Search
CPC .. B41J 2/0458; B41J 2/04563; B41J 2/04528; B41J 2/04565; B41J 2/14153
USPC ..... 347/17, 19, 20, 40, 42, 48–50, 56, 58, 347/61
See application file for complete search history.

(56) References Cited

U.S. PATENT DOCUMENTS 6,527,367 B2 * 3/2003 Yabe ..... 347/43
7,909,423 B2 * 3/2011 Saikawa et al. ..... 347/17
8,070,263 B2 * 12/2011 Oohashi et al. ..... 347/58

FOREIGN PATENT DOCUMENTS

WO 2012/044299 A1 4/2012

* cited by examiner

*Primary Examiner* — Thinh Nguyen
(74) *Attorney, Agent, or Firm* — Canon USA Inc. IP Division

(57) ABSTRACT

A liquid ejection head substrate includes:

a plurality of energy generating element arrays each including a plurality of energy generating elements configured to generate energy for ejecting liquid;

a supply port array in which a plurality of supply ports configured to supply liquid to the plurality of energy generating elements are arranged between the plurality of energy generating element arrays in an arrangement direction in which the plurality of energy generating elements are arranged;

a temperature detection element that is configured to detect a temperature of the liquid ejection head substrate and that is provided on one side of the supply port array; and a heating element that is configured to heat the liquid ejection head substrate and that is provided on the other side of the supply port array.

17 Claims, 11 Drawing Sheets

LIQUID EJECTION HEAD SUBSTRATE AND LIQUID EJECTION HEAD

BACKGROUND OF THE INVENTION

1. Field of the Invention

The present invention relates to a liquid ejection head substrate used in a liquid ejection head that ejects liquid, and to a liquid ejection head.

2. Description of the Related Art

In general, regarding inkjet print heads (hereinafter, also called "print heads"), which are representative examples of liquid ejection heads, the viscosity of ink used for printing increases as ambient temperature decreases. Hence, when a print head is used in environments with very low temperatures, there may be a case where the volume of ink ejected from the print head is decreased (variations in ejection volume) or ink is not ejected normally (defective ejection). In this case, in images obtained by printing, uneven density due to variations in ejection volume, unfavorable dot shapes due to defective ejection, or the like is observed. To solve these problems, control is performed in such a manner that the print head is heated before or during printing operations so as to be in a predetermined temperature range, thereby regulating temperature distribution.

Examples of known configurations for the above-described control include a configuration in which heat generating elements (hereinafter also called "heating elements") for heat application are provided on an inkjet print head substrate (hereinafter, also called a "substrate"). By driving these heating elements, the temperatures of the substrate and ink within the substrate are adjusted.

In International Publication No. 2012/044299, as illustrated in FIG. 2 thereof, a configuration is disclosed in which an ink supply port having a shape extending along ejection port arrays are provided in the center of the substrate, and a plurality of temperature detection elements and a plurality of heating elements are provided for the ejection ports arranged on both sides of the ink supply port. With this configuration, regions having a low temperature can be selectively heated using the heating elements, by detecting the temperature distribution of the substrate using the temperature detection elements.

However, in International Publication No. 2012/044299, since the temperature detection elements and the heating elements are provided for each of the ejection port arrays, the numbers of the temperature detection elements and the heating elements are increased when the number of the ejection port arrays is increased to increase the number of colors and enhance image quality. As a result, a larger space in which to arrange the temperature detection elements, heating elements, and drive circuits for driving these elements is required, thereby causing increases in the area of the substrate and the manufacturing cost of the substrate. Since it is more advantageous when the number of the printing elements in the ejection port array is larger from the viewpoint of obtaining a higher speed and higher quality, it is preferable to decrease the length of the substrate in a direction perpendicular to the direction in which the ejection port arrays extend, thereby suppressing an increase in the area of the substrate, to realize a higher speed and higher quality together with suppression of the manufacturing cost.

On the other hand, when the temperature detection elements and heating elements are not provided for each ejection port array, since the substrate is partitioned by the supply port having a shape extending in the direction in which the ejection port arrays extend, it is difficult to sufficiently heat the regions on the two sides of the supply port. Hence, it becomes difficult to regulate the temperature distribution of the substrate.

Further, when the temperature detection elements and the heating elements are arranged close to each other, as in International Publication No. 2012/044299, the temperatures of regions heated by the heating elements are detected and, hence, the accuracy of temperature detection, which is the base of temperature control of the heating elements, is decreased, whereby it becomes difficult to regulate the temperature distribution over the whole substrate.

SUMMARY OF THE INVENTION

A liquid ejection head substrate according to the present invention includes:

a plurality of energy generating element arrays each including a plurality of energy generating elements configured to generate energy for ejecting liquid;

a supply port array in which a plurality of supply ports configured to supply liquid to the plurality of energy generating elements are arranged between the plurality of energy generating element arrays in an arrangement direction in which the plurality of energy generating elements are arranged;

a temperature detection element that is configured to detect a temperature of the liquid ejection head substrate and that is provided on one side of the supply port array; and a heating element that is configured to heat the liquid ejection head substrate and that is provided on another side of the supply port array.

A liquid ejection head according to the present invention includes a liquid ejection head substrate and an ejection port forming member.

The liquid ejection head substrate includes:

a plurality of energy generating element arrays each including a plurality of energy generating elements generate energy for ejecting liquid;

a supply port array in which a plurality of supply ports configured to supply liquid to the plurality of energy generating elements are arranged between the plurality of energy generating element arrays in an arrangement direction in which the plurality of energy generating elements are arranged;

a temperature detection element that is configured to detect a temperature of the liquid ejection head substrate and that is provided on one side of the supply port array; and a heating element that is configured to heat the liquid ejection head substrate and that is provided on another side of the supply port array.

In the ejection port forming member, an ejection port array including a plurality of ejection ports configured to eject liquid is provided so as to correspond to the energy generating element array.

Further features of the present invention will become apparent from the following description of exemplary embodiments with reference to the attached drawings.

DESCRIPTION OF THE EMBODIMENTS

First Embodiment

Figure 1:
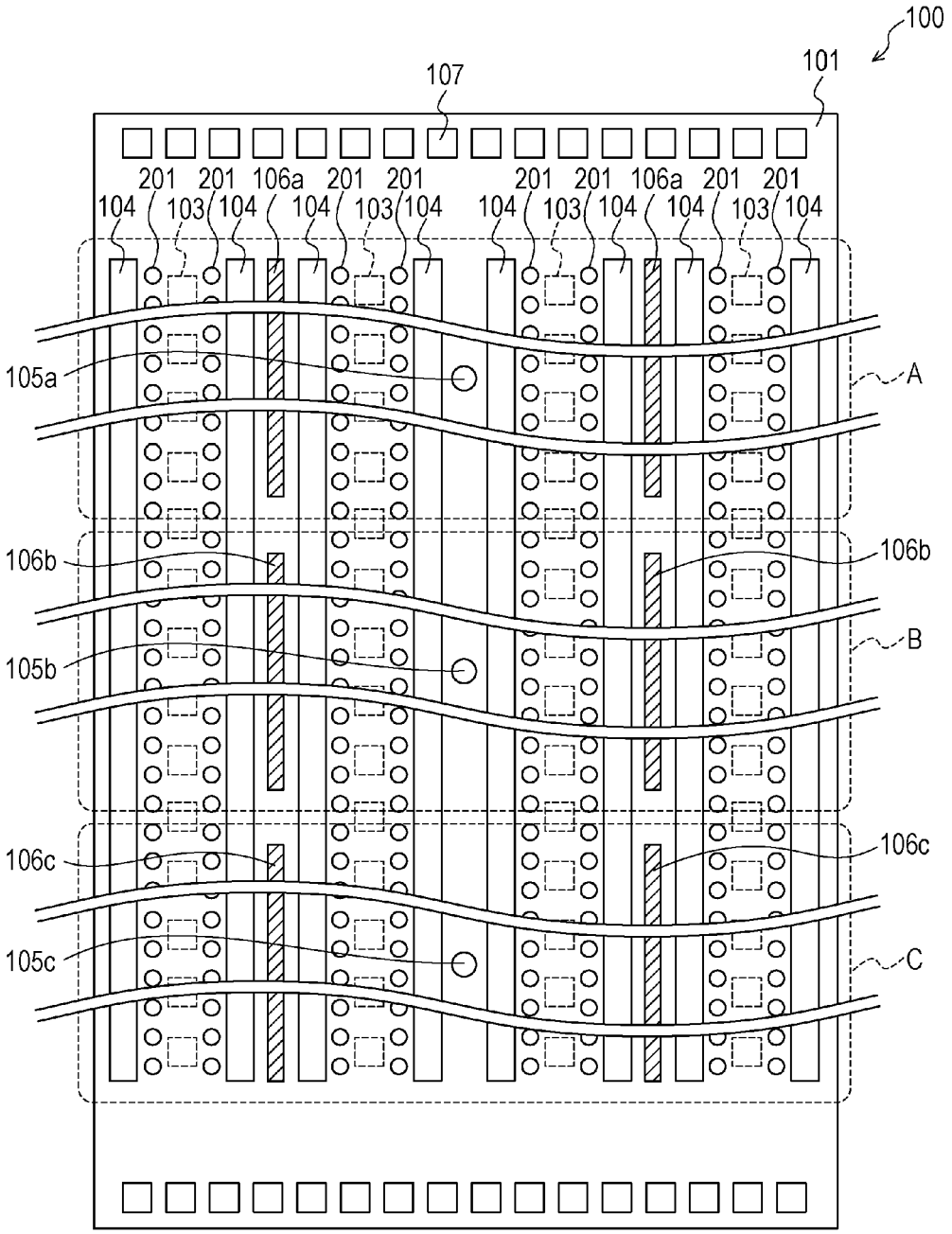
FIG. 1 is a plan view of the layout of a liquid ejection head according to a first embodiment of the present invention.
Figure 2:
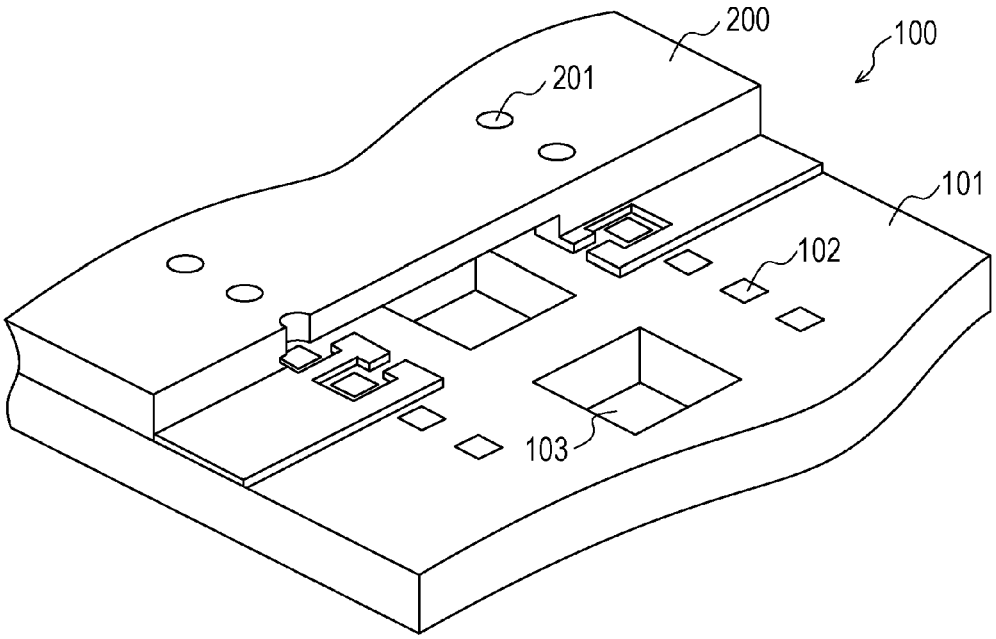
FIG. 2 is a perspective view for explaining the liquid ejection head according to the first embodiment of the present invention.

FIG. 1 to FIG. 4 are diagrams illustrating an inkjet print head 100, functioning as a liquid ejection head, according to a first embodiment of the present invention. FIG. 1 is a schematic plan view of the layout of the inkjet print head 100. FIG. 2 is a partial perspective view of the inkjet print head 100. As illustrated in FIG. 2, the inkjet print head 100 includes an element substrate 101, functioning as a liquid ejection head substrate, and an ejection port forming member 200.

A plurality of printing element arrays (energy generating element arrays) each formed of a plurality of printing elements 102, functioning as energy generating elements, generating energy for ejecting liquid are provided on the element substrate 101 in a direction perpendicular to an arrangement direction in which the printing elements 102 are arranged. In the present embodiment, thermal energy generating elements that eject ink using thermal energy are used as the printing elements 102.

A plurality of ejection port arrays each formed of a plurality of ejection ports 201 for ejecting ink are provided in the ejection port forming member 200. As illustrated in FIG. 2, in the inkjet print head 100, arrays of the printing elements 102 and arrays of the ejection ports 201 are provided at positions that correspond to each other.

In the element substrate 101, supply ports 103 that supply ink to the printing elements 102 are formed in such a manner as to extend through the element substrate 101, and a supply port array formed of a plurality of the supply ports 103 is provided in a region between the arrays of the printing elements 102. Further, a drive circuit 104 for driving the printing elements 102 is provided for each array of the printing elements 102, and the drive circuit 104 is arranged in a region on a side of the array of the printing elements 102 opposite the side thereof where the array of the supply ports 103 is provided.

Ink is supplied to a region above the printing element 102 from the back surface of the element substrate 101 through the supply port 103. The printing element 102 selected by the drive circuit 104 is heated, whereby bubbles are generated in the ink above the printing element 102 and the ink is ejected from the ejection port 201.

As illustrated using broken lines in FIG. 1, when the region of the element substrate 101 is divided into regions A to C in the arrangement direction in which the ejection ports 201 are arranged (arrangement direction in which the printing elements 102 are arranged), a temperature detection element 105 for detecting the temperature of the element substrate 101 is provided between the drive circuits 104 in each of the regions A to C. The temperature detection elements 105 (105*a* to 105*c*) are arranged respectively in the centers of the regions A to C in a direction perpendicular to the arrangement direction in which the printing elements 102 are arranged. The temperature detection elements 105*a* to 105*c* are used to detect the temperatures of the regions A to C. Examples of the temperature detection elements 105 used here include elements, such as diodes and resistors, whose characteristics change in accordance with temperature.

In regions between the drive circuits 104 where the temperature detection elements 105 are not provided, heating elements 106 (106*a* to 106*c*) for heating the element substrate 101 to an extent insufficient to cause ink to be ejected are provided in such a manner as to correspond to the respective temperature detection elements 105*a* to 105*c*. In the present embodiment, with the group of the temperature detection elements 105 (group of the temperature detection elements 105*a* to 105*c*) as the center, two groups of the heating elements 106 (two groups of the heating elements 106*a* to 106*c*) are respectively arranged on the two sides of the group of the temperature detection elements 105 in such a manner that two of the heating elements 106 are arranged in each of the regions A to C.

Electric connection pads 107 for external electric connection are arranged along the edges of the element substrate 101. Through the electric connection pads 107, power is supplied from the outside to, and control signals are input/output to/from, the printing elements 102, the drive circuits 104, the heating elements 106, and the like.

Figure 3:
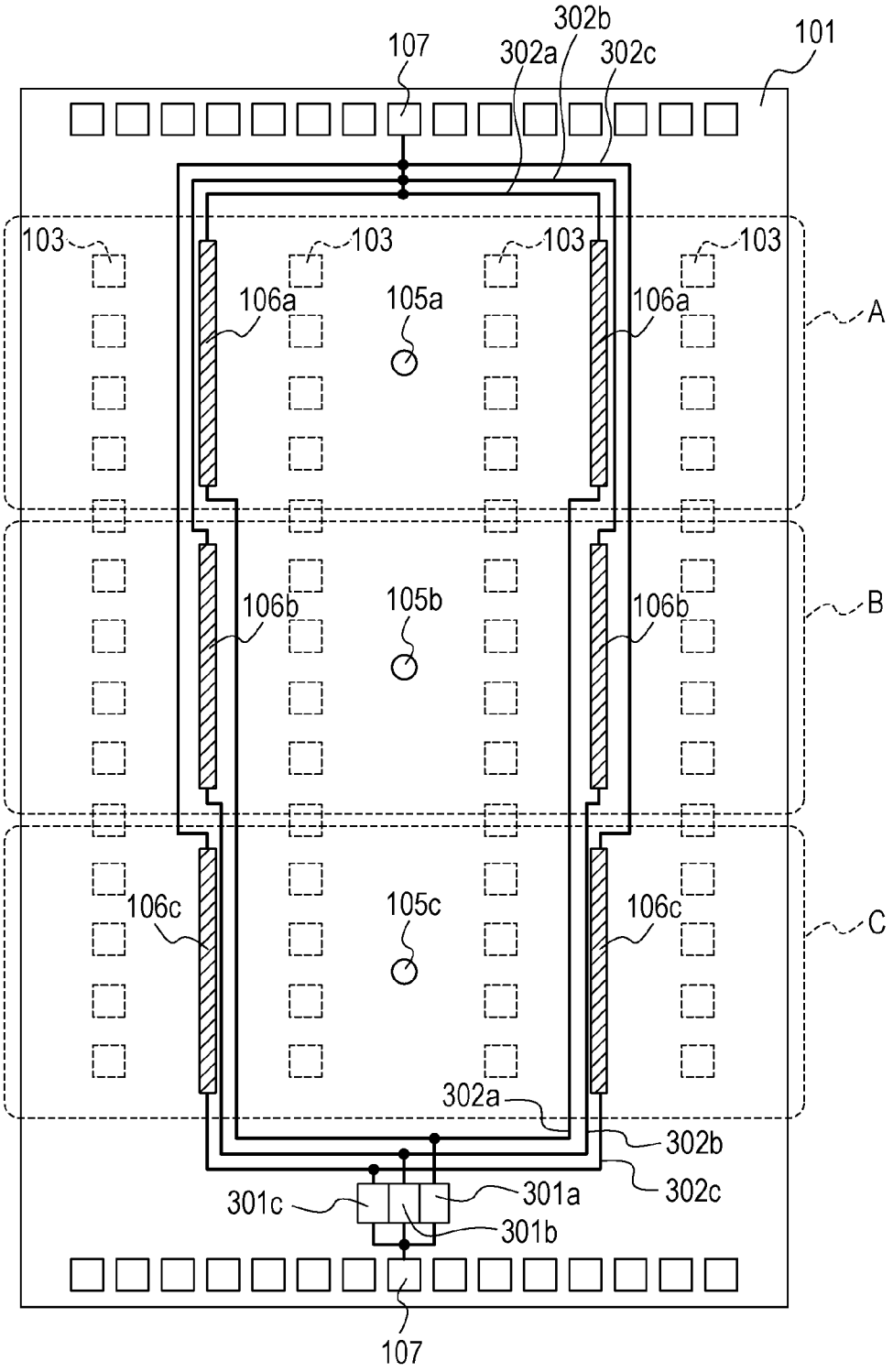
FIG. 3 is a diagram for explaining heating elements according to the first embodiment of the present invention.

FIG. 3 illustrates a layout of wiring connection between the heating elements 106 and the electric connection pads 107. The heating elements 106*a* to 106*c* are commonly connected to the electric connection pad 107 provided on the upper side in the figure, respectively through wiring lines 302*a* to 302*c*. Further, the heating elements 106*a* to 106*c* are respectively connected to switching elements 301*a* to 301*c* which perform switching among the heating elements 106 to be driven. The switching elements 301*a* to 301*c* are commonly connected to the electric connection pad 107 on the lower side in the figure.

Figure 4:
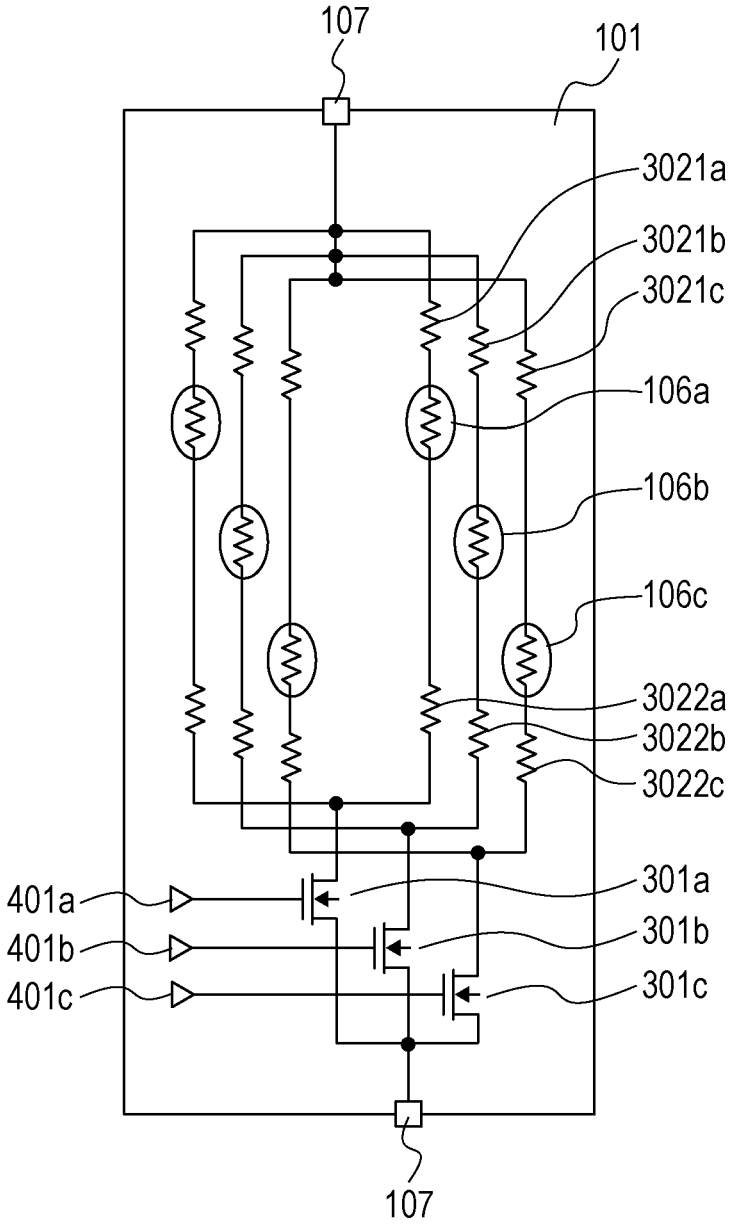
FIG. 4 is an equivalent circuit diagram for explaining how to drive the heating elements according to the first embodiment of the present invention.

FIG. 4 is an equivalent circuit diagram illustrating how to drive the heating elements 106. Transistors are used as the switching elements 301*a* to 301*c* and the transistors are respectively connected to control terminals 401*a* to 401*c* that perform switching control of the transistors. Regarding the wiring line 302*a* connected to the heating elements 106*a*, it is assumed that parasitic resistance components of portions of the wiring line 302*a* (FIG. 3) on the upper side in the figure are represented by resistors 3021*a* and parasitic resistance components of portions of the wiring line 302*a* (FIG. 3) on the lower side in the figure are represented by resistors 3022*a*. Similarly, parasitic resistance components of the upper portions of the wiring lines 302*b* and 302*c* of the heating elements 106*b* and 106*c* are represented by resistors 3021*b* and 3021*c*, and parasitic resistance components of the lower portions of the wiring lines 302*b* and 302*c* are represented by resistors 3022*b* and 3022*c*.

Heating performed by the heating elements 106*a* to 106*c* is controlled by control signals provided through the control terminals 401*a* to 401*c* which are connected to the switching elements 301*a* to 301*c*. The two heating elements 106*a* provided in the region A are connected in parallel to the switching element 301*a*, the two heating elements 106*b* provided in the region B are connected in parallel to the switching element 301*b*, and the two heating elements 106*c* provided in the region C are connected in parallel to the switching element 301*c*. The two heating elements 106 in each of the regions A to C are controlled at the same time through driving control based on the control signal.

Pieces of temperature information detected through changes in the characteristics of the temperature detection elements 105 are converted into electric signals, which are input through the electric connection pads 107 to a main body circuit, outside of the inkjet print head 100, controlling the inkjet print head 100 or to a control circuit within the element substrate 101. The temperatures indicated by the detected temperature information are compared with a predetermined set temperature by a control circuit provided outside of the element substrate 101 or within the element substrate 101. When the temperature of one of the regions A to C is lower than the set temperature, a signal is input to a corresponding one of the control terminals 401*a* to 401*c* connected to the switching elements 301*a* to 301*c*, whereby the heating element 106 provided in the corresponding region is driven. When a temperature higher than the set temperature is detected by the temperature detection elements 105*a* to 105*c*, control is performed in such a manner that the driving of the corresponding heating element 106 is stopped.

As described above, in the present embodiment, the temperature detection elements 105*a* to 105*c* are provided respectively in the regions A to C, and the corresponding heating elements 106*a* to 106*c* provided in the regions A to C are controlled. In the case where the numbers of driving operations for the printing elements 102 per unit time are different among the regions, the heating elements 106 are continuously controlled in such a manner that the temperatures of the respective regions are maintained at the set temperature, as described above, thereby regulating the temperature distribution within the element substrate 101. As a result, variations in the ejection volume of ink and the ejection speed of ink are suppressed, resulting in high-quality printing.

Here, as illustrated in FIG. 1 and FIG. 3, in the present embodiment, a configuration is employed in which the group of the temperature detection elements 105 is provided on one side of one of the arrays of the supply ports 103, and the group of the heating elements 106 is provided on the other side.

A plurality of the arrays of the supply ports 103 are provided in a direction perpendicular to the arrangement direction in which the printing elements 102 are arranged. When these arrays are called the first supply port array, the second supply port array, and the third supply port array, from left to right in this order in FIG. 1, the temperature detection elements 105 and the heating elements 106 are arranged as follows. That is, between the first supply port array and the second supply port array, the heating elements 106 are provided but the temperature detection elements 105 are not provided. Between the second supply port array and the third supply port array, the temperature detection elements 105 are provided but the heating elements 106 are not provided.

As described above, in the present embodiment, a plurality of the supply ports 103 are provided in the regions A to C arranged in the arrangement direction in which the printing elements 102 are arranged, and the element substrate 101 continuously extends, through regions among the plurality of the supply ports 103, in a perpendicular direction which is perpendicular to the arrangement direction in which the printing elements 102 are arranged. As a result, even when the temperature detection elements 105 and the heating elements 106 are not provided for each array of the printing elements 102, as is the case with the present embodiment, temperature control using the temperature detection elements 105 and the heating elements 106 can be performed in the perpendicular direction with high accuracy.

Hence, in the present embodiment, compared with the case in which the temperature detection elements 105 and the heating elements 106 are provided on both sides of the supply ports 103, the number of the temperature detection elements 105 and the number of elements for controlling the temperature detection elements 105 can be decreased. In this manner, according to the present embodiment, the temperature distribution in the element substrate can be regulated while suppressing an increase in the area of the element substrate due to the elements related to temperature control.

Figure 5:
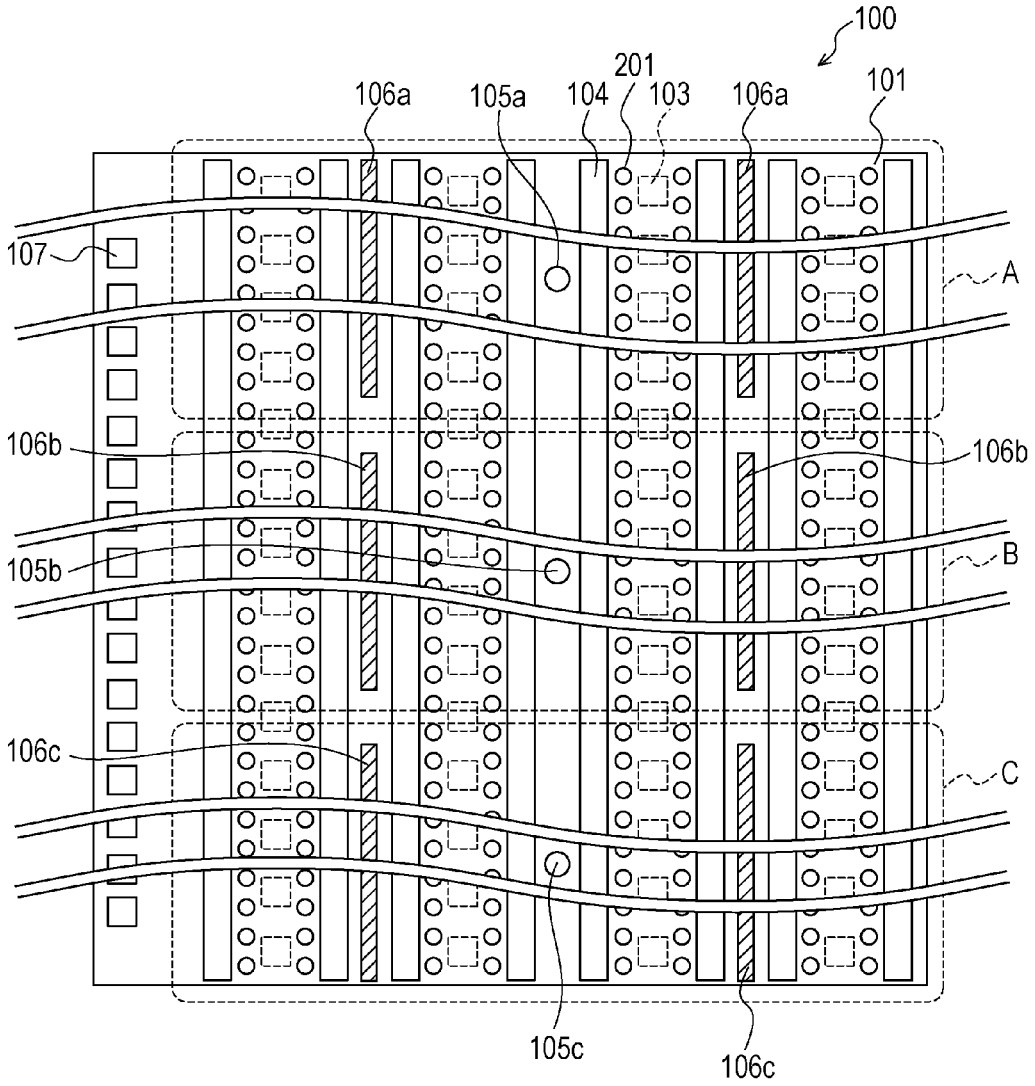
FIG. 5 is a plan view of the layout of a liquid ejection head according to a modification of the first embodiment of the present invention.

FIG. 5 is a diagram for explaining a modification of the first embodiment. In FIG. 1, the electric connection pads 107 are arranged in the peripheral portions near the short sides of the element substrate 101. However, in the present modification, the electric connection pads 107 are arranged in the peripheral portion near the long side of the element substrate 101.

With this configuration, the number of power supply pads for supplying power to, for example, the printing elements 102 can be increased and, hence, a current flowing through each pad is decreased, whereby a voltage drop across the pad is decreased. As a result, power can be efficiently supplied to the printing elements 102. Further, since distances between the printing elements 102 and the electric connection pads 107 are reduced, the lengths of wiring lines for connecting them can be reduced, whereby power can be efficiently supplied to the printing elements 102. In the case where the number of pads for inputting data for selecting the printing elements 102 is increased, the number of data blocks input to the element substrate 101 per unit time is increased, whereby high-speed printing is realized.

Second Embodiment

Figure 6:
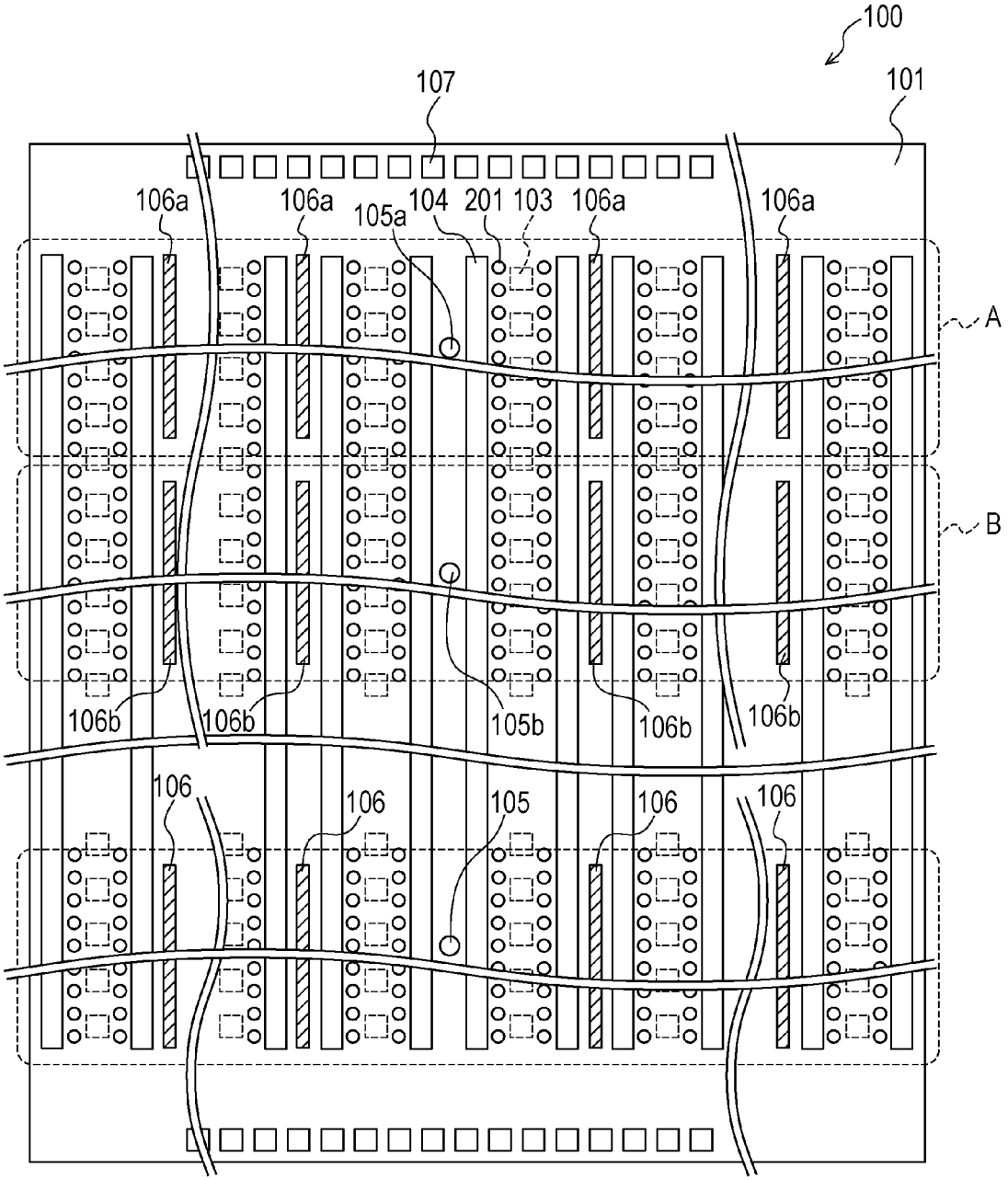
FIG. 6 is a plan view of the layout of a liquid ejection head according to a second embodiment of the present invention.
Figure 7:
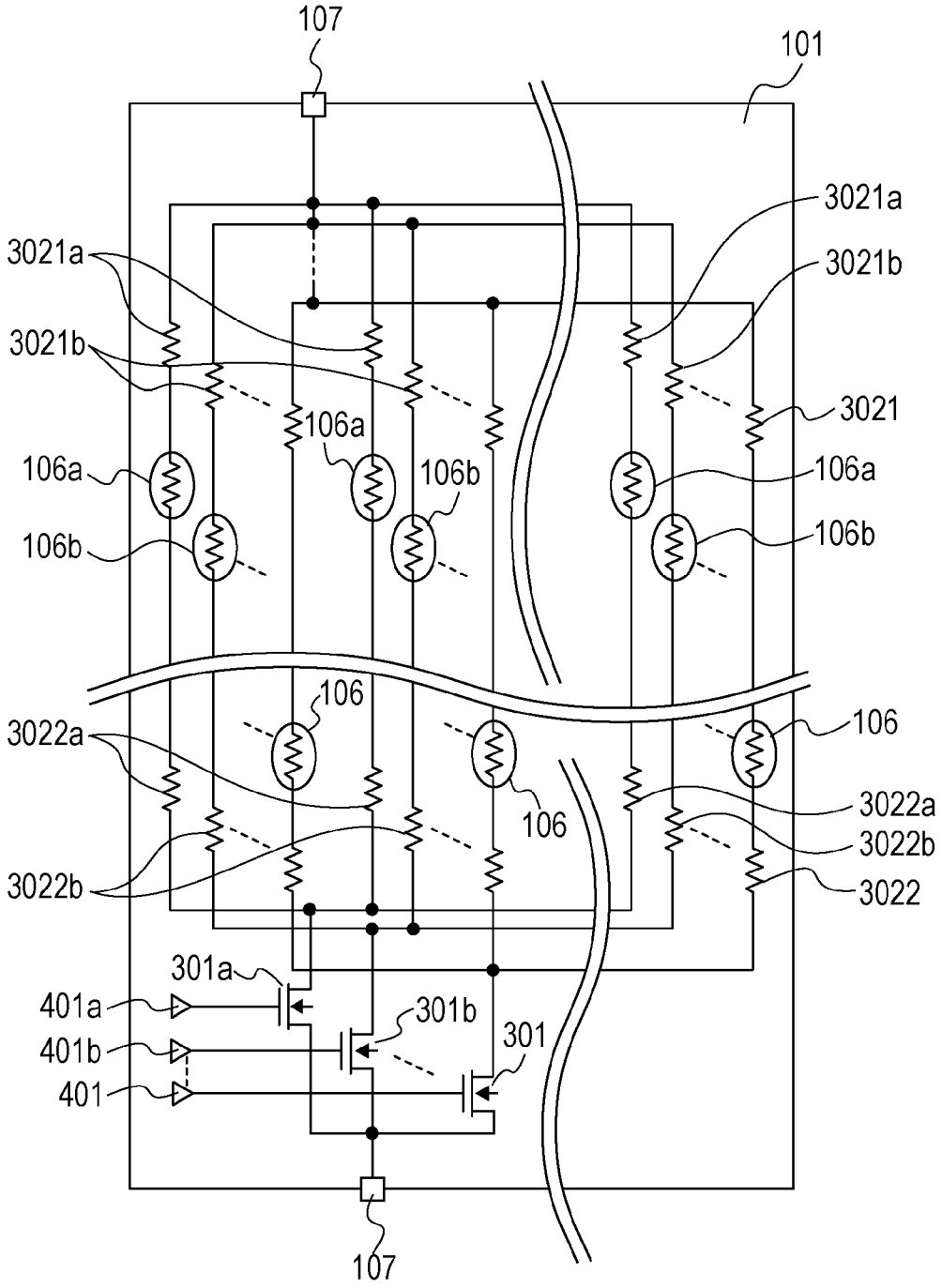
FIG. 7 is an equivalent circuit diagram for explaining how to drive heating elements according to the second embodiment of the present embodiment.

FIG. 6 and FIG. 7 are diagrams for explaining the configuration of an inkjet print head 100 according to a second embodiment of the present invention. FIG. 6 is a schematic plan view of the layout of the inkjet print head 100. Compared with the first embodiment, the present embodiment employs a configuration in which the sizes of the arrays of the printing elements 102, the ejection ports 201, and the supply ports 103 are large and the numbers of the respective arrays are increased.

Also in the present embodiment, similarly to the above-described embodiment, a plurality of the temperature detection elements 105 are arranged, in the center of the element substrate 101 in a direction perpendicular to an arrangement direction in which the printing elements 102 are arranged, in the arrangement direction. In portions between the drive circuits 104 where the temperature detection elements 105 are not provided, the heating elements 106 are respectively provided in regions, illustrated by broken lines in FIG. 6, where the respective temperature detection elements 105 are provided. In accordance with an increase in the number of the arrays of the printing elements 102, the number of the heating elements 106 arranged in the respective regions corresponding to the temperature detection elements 105 is increased.

FIG. 7 is an equivalent circuit diagram of the heating elements 106 of the present embodiment. Also in the present embodiment, the heating elements 106 in the same region are connected in parallel to a corresponding switching element 301. Similarly to the first embodiment, in each region, the driving of the heating elements 106 arranged in the region is controlled on the basis of information about the temperature detected by the temperature detection element 105 in the region.

Similarly to the above-described embodiment, a plurality of the supply ports 103 are provided for the array of the printing elements 102 in each region, and the element substrate 101 continuously extends, through regions among the plurality of the supply ports 103, in a perpendicular direction which is perpendicular to the direction in which the printing elements 102 are arranged. As a result, even when the number of the arrays of the printing elements 102 is large, it is only required that a single temperature detection element 105 be provided for each region in the center in the perpendicular direction. Hence, an increase in the area of the element substrate 101 due to elements related to temperature control is suppressed.

Third Embodiment

Figure 8:
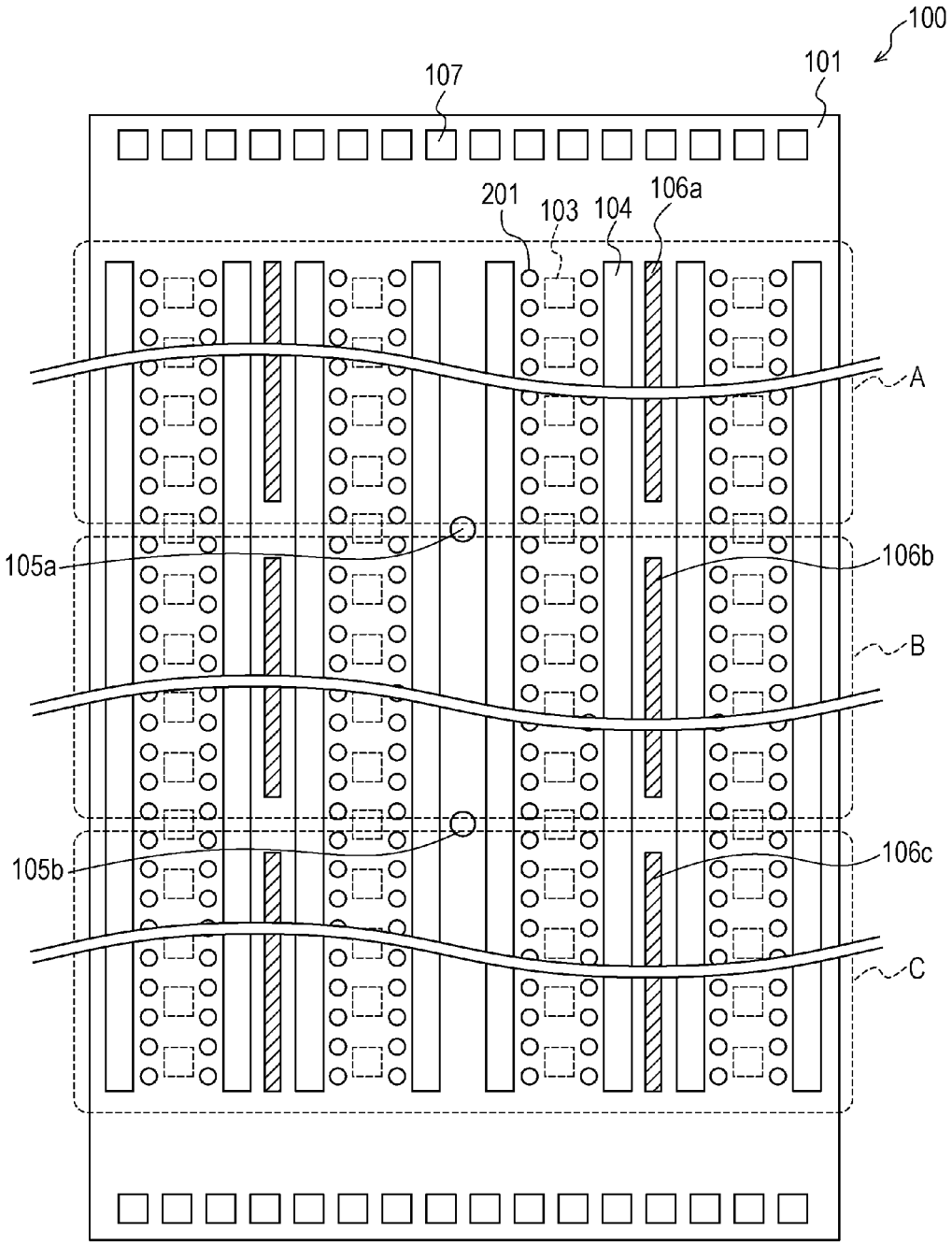
FIG. 8 is a plan view of the layout of a liquid ejection head according to a third embodiment of the present invention.

FIG. 8 is a schematic plan view of the layout of an inkjet print head 100 according to a third embodiment of the present invention. The present embodiment has a configuration in which the temperature detection element 105*a* is provided between the region A and the region B and the temperature detection element 105*b* is provided between the region B and the region C. In the present embodiment, the temperature of the region A is detected by the temperature detection element 105*a*, the temperature of the region C is detected by the temperature detection element 105*b*, and the heating elements 106*a* and 106*c* are controlled on the basis of information about the respective temperatures detected by them. The heating element 106*b* is controlled on the basis of the temperature of the region B which is obtained from the two detection results of the temperature detection elements 105*a* and 105*b*.

In the present embodiment, by providing the temperature detection elements 105 between the neighboring regions, the number of the temperature detection elements 105 can be decreased, compared with the first embodiment in which the temperature detection elements 105 are respectively provided for the regions A to C. As a result, an increase in the area of the element substrate 101 due to elements related to temperature control is further suppressed.

Fourth Embodiment

Figure 9:
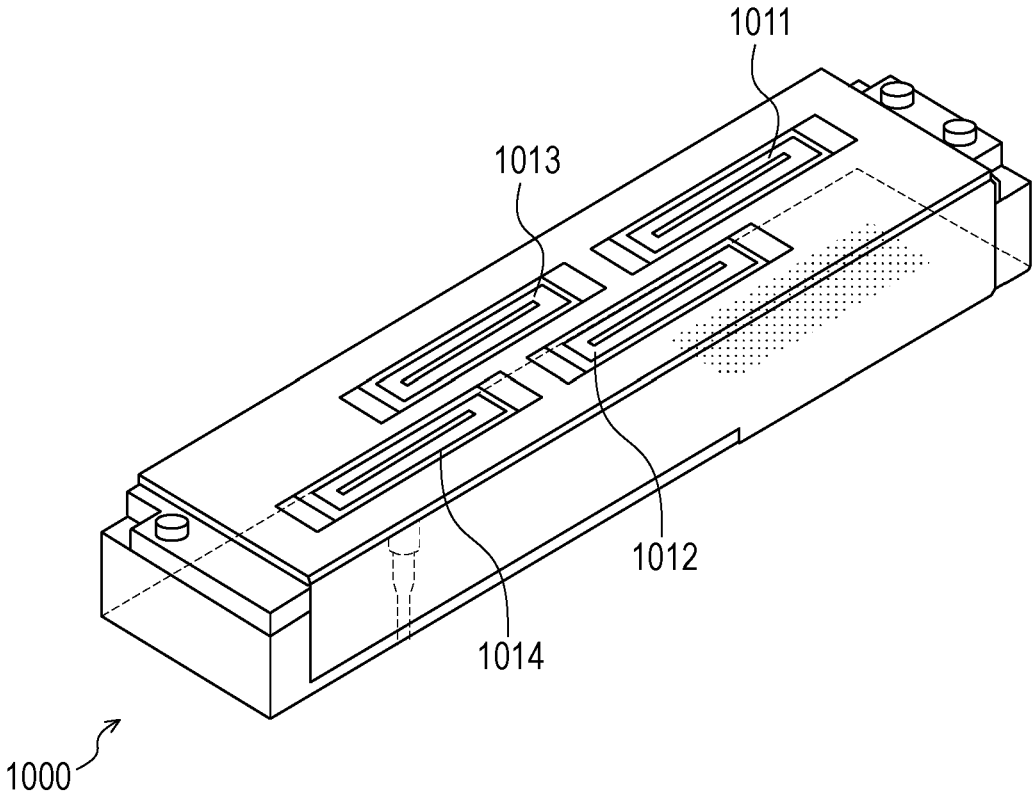
FIG. 9 is a diagram for explaining a liquid ejection head according to a fourth embodiment of the present invention.
Figure 10:
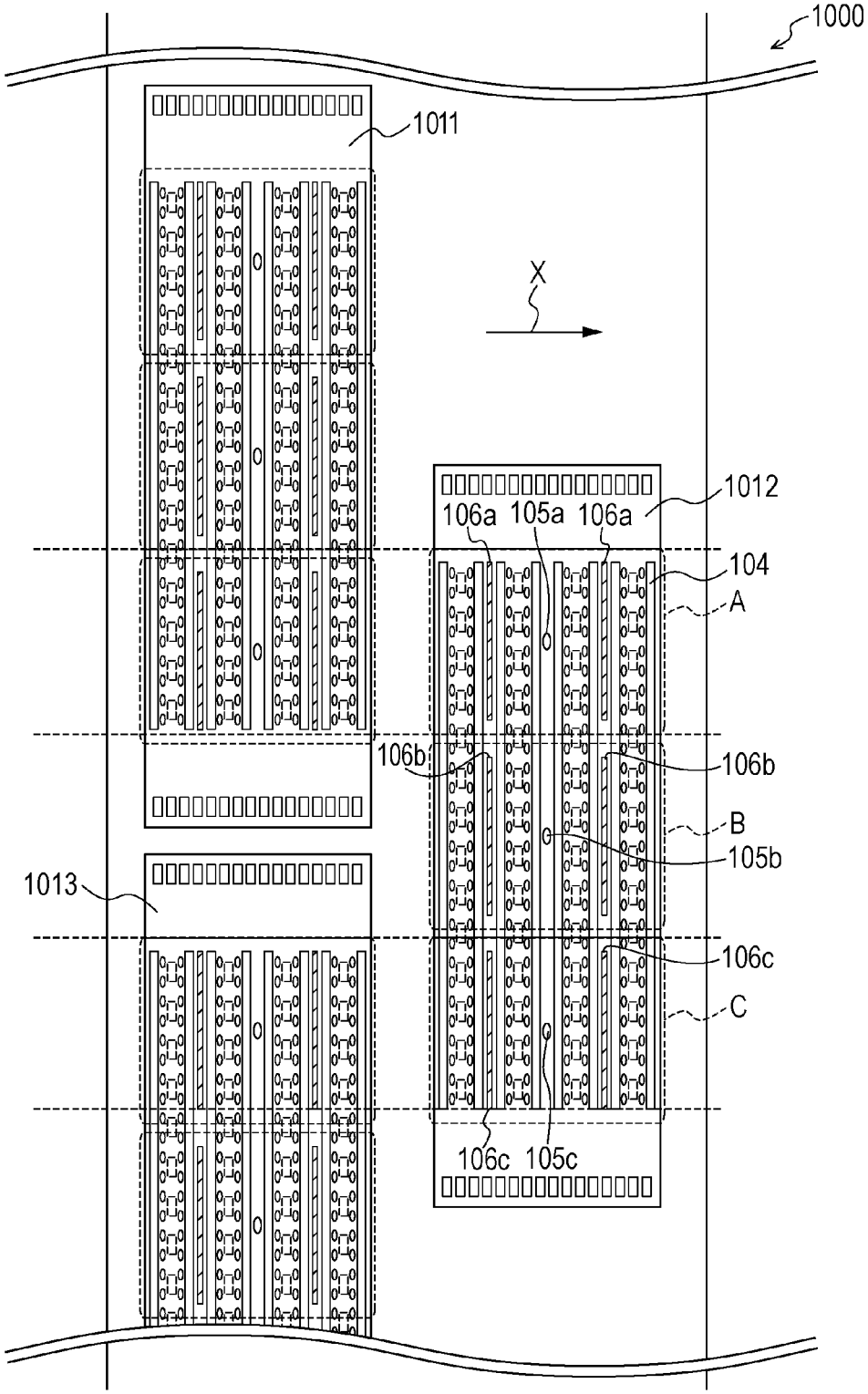
FIG. 10 is a plan view illustrating a portion of the liquid ejection head according to the fourth embodiment of the present invention.

FIG. 9 and FIG. 10 are diagrams for explaining an inkjet print head, functioning as a liquid ejection head, according to a fourth embodiment of the present invention. An inkjet print head 1000 of the present embodiment has a configuration in which a plurality of inkjet print heads 1011 to 1014 are mounted. FIG. 9 is a perspective view of the configuration of the inkjet print head 1000, and FIG. 10 is a plan view illustrating a portion of the inkjet print head 1000 viewed from an ejection ports 201 side.

In the inkjet print head 1000 of the present embodiment, by arranging the plurality of inkjet print heads 1011 to 1014 in the arrangement direction in which the printing elements 102 are arranged, printing over a long distance in the arrangement direction is realized. An arrow X in FIG. 10 indicates the conveyance direction of a print medium with respect to the inkjet print head 1000.

Here, a region A of the inkjet print head 1012 is arranged in such a manner as to partially overlap a portion of the inkjet print head 1011 when viewed in the direction of the arrow X. Hence, the same portion of a print medium can be printed by the inkjet print heads 1011 and 1012 using the printing elements 102 arranged in the overlapping region. Similarly, a region C of the inkjet print head 1012 is arranged in such a manner as to overlap a portion of the inkjet print head 1013 when viewed in the direction of the arrow X. Hence, the same portion of a print medium can be printed by the inkjet print heads 1012 and 1013 using the printing elements 102 arranged in the overlapping region. In the regions where the neighboring inkjet print heads overlap, by performing printing using ink droplets ejected from the two print heads, the occurrence of a case in which an image is emphasized due to an influence of manufacturing errors of the print heads can be suppressed.

When printing is performed in this manner, the driving frequencies of the printing elements 102 when an image having a uniform density is printed are as follows. In the case of the inkjet print head 1012, the driving frequencies of the printing elements 102 in the regions A and C are lower than that in the region B. Hence, the temperatures of the regions A and C of the inkjet print head 1012 are lower than the temperature of the region B. In this manner, the driving frequencies of the printing elements 102 are different in an overlapping region and a non-overlapping region in the inkjet print head when viewed in the conveyance direction of a print medium.

Also in the present embodiment, the temperature detection elements 105*a* to 105*c* and the heating elements 106*a* to 106*c* are provided respectively in the regions A to C, as described above. In other words, the temperature detection element 105 and the heating elements 106 are provided in each of the regions A and C overlapping with neighboring inkjet print heads and the region B not overlapping with the neighboring inkjet print heads. On the basis of information about the temperatures detected by the temperature detection elements 105 respectively arranged in the regions A to C, driving of the heating elements 106*a* to 106*c* is controlled, whereby temperature distribution within the inkjet print head can be regulated. When the driving frequencies of the printing elements 102 are different among the regions of the inkjet print head, temperature distribution can be regulated by providing the temperature detection element 105 and the heating elements 106 in each region.

Fifth Embodiment

Figure 11:
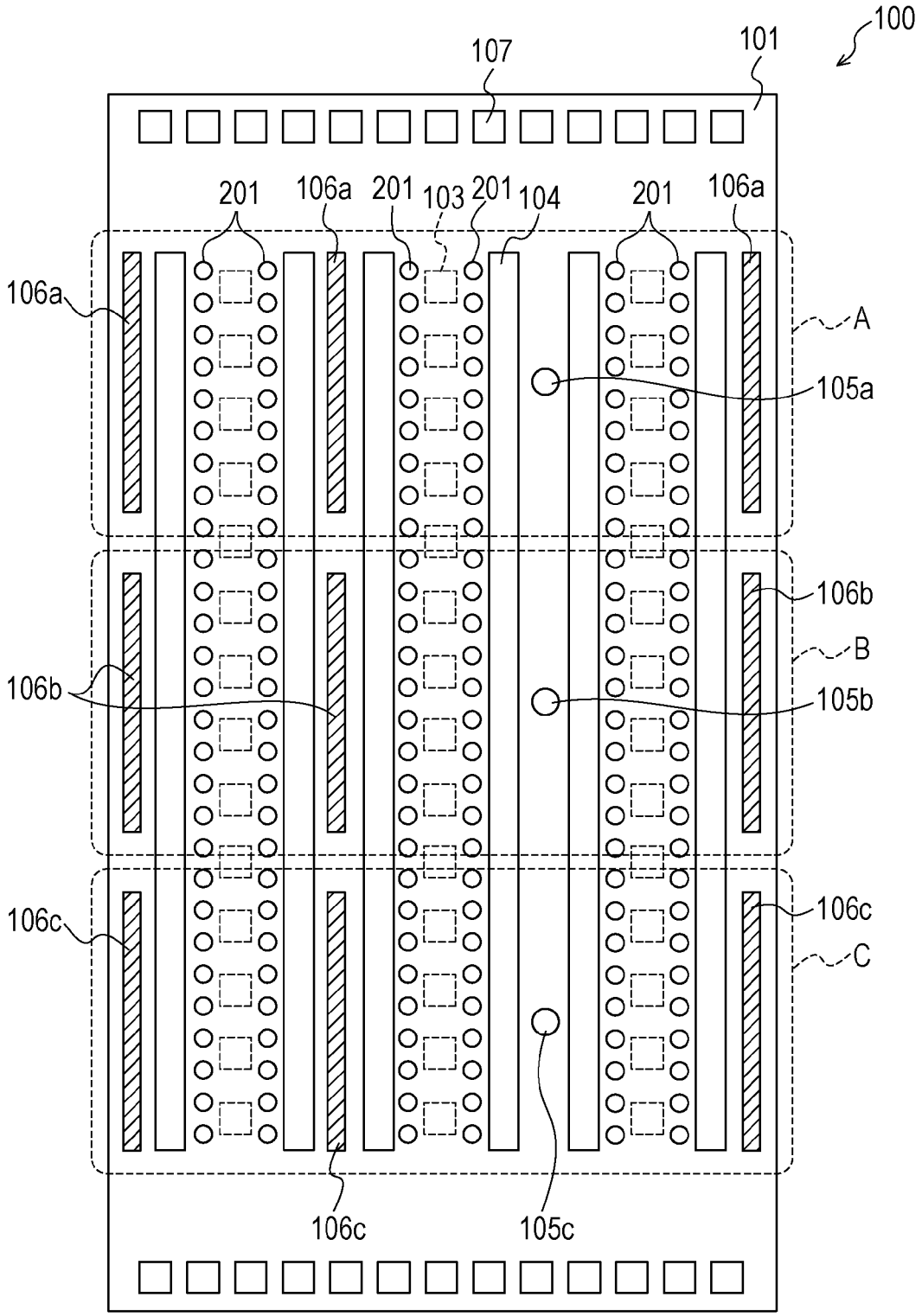
FIG. 11 is a plan view of the layout of a liquid ejection head according to a fifth embodiment of the present invention.

FIG. 11 is a diagram for explaining an inkjet print head 100 according to a fifth embodiment of the present invention and illustrates a schematic plan view of the layout of the inkjet print head 100.

The present embodiment employs a configuration in which six arrays of the ejection ports 201 are arranged in the inkjet print head 100. The temperature detection elements 105*a* to 105*c* are arranged at positions which are displaced from the centers of the element substrate 101 in a direction perpendicular to the direction in which the printing elements 102 are arranged (i.e., the direction in which the ejection ports 201 are arranged). The groups of the heating elements 106 (106*a* to 106*c*) are arranged in such a manner as to be asymmetrical about the group of the temperature detection elements 105 (105*a* to 105*c*). Specifically, for the temperature detection elements 105*a* to 105*c*, two of the heating elements 106 are arranged on the left side in the figure in each of the regions A to C, and one of the heating elements 106 is arranged on the right side in the figure in each of the regions A to C.

Also in the present embodiment, the element substrate 101 continuously extends, through regions among the plurality of the supply ports 103, in a perpendicular direction which is perpendicular to the direction in which the printing elements 102 are arranged. Hence, an uneven temperature distribution in the perpendicular direction is unlikely to be generated. In particular, when the length of the element substrate 101 in the perpendicular direction is small, the temperature distribution becomes more uniform. As a result, the configuration may be employed in which the temperature detection elements 105 and the heating elements 106 are not arranged symmetrically on the element substrate 101, as described above.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-077853, filed Apr. 3, 2013 which is hereby incorporated by reference herein in its entirety.

What is claimed is:

1. A liquid ejection head substrate comprising:

a plurality of energy generating element arrays each including a plurality of energy generating elements configured to generate energy for ejecting liquid;

a supply port array in which a plurality of supply ports configured to supply liquid to the plurality of energy generating elements are arranged between the plurality of energy generating element arrays in an arrangement direction in which the plurality of energy generating elements are arranged;

a temperature detection element that is configured to detect a temperature of the liquid ejection head substrate and that is provided on one side of the supply port array; and a heating element that is configured to heat the liquid ejection head substrate and that is provided on another side of the supply port array, wherein the supply port array is constituted by a first supply port array, a second supply port array, and a third supply port array, sequentially provided in a direction perpendicular to the arrangement direction, wherein one of the temperature detection element and the heating element is provided between the first supply port array and the second supply port array, and wherein another of the temperature detection element and the heating element is provided between the second supply port array and the third supply port array.

2. The liquid ejection head substrate according to claim 1, wherein the temperature detection element is one of a plurality of temperature detection elements that are arranged on one side of the supply port array in the arrangement direction and that form a temperature detection element group; and wherein the heating element is one of a plurality of heating elements that are arranged on another side of the supply port array in the arrangement direction and that form a heating element group.

3. The liquid ejection head substrate according to claim 2, wherein the heating elements are provided so as to correspond to the respective temperature detection elements.

4. The liquid ejection head substrate according to claim 2, wherein the number of the temperature detection elements forming the temperature detection element group is identical to the number of the heating elements forming the heating element group.

5. The liquid ejection head substrate according to claim 2, wherein the number of the temperature detection elements forming the temperature detection element group is smaller than the number of the heating elements forming the heating element group.

6. The liquid ejection head substrate according to claim 2, further comprising:

switching elements configured to switch driving of the heating elements, wherein the plurality of heating elements forming the heating element group are connected to different switching elements from one another.

7. The liquid ejection head substrate according to claim 6, wherein another heating element group formed of heating elements is provided, and wherein the heating elements in the heating element groups in an identical region extending in a direction perpendicular to the arrangement direction are connected to a common switching element among the switching elements.

8. The liquid ejection head substrate according to claim 1, wherein the heating element is provided in a center of the liquid ejection head substrate in a direction perpendicular to the arrangement direction.

9. The liquid ejection head substrate according to claim 1, wherein the heating element heats the liquid ejection head substrate in response to a temperature detected by the temperature detection element.

10. A liquid ejection head substrate comprising:

a plurality of energy generating element arrays each including a plurality of energy generating elements configured to generate energy for ejecting liquid;

a supply port array in which a plurality of supply ports configured to supply liquid to the plurality of energy generating elements are arranged between the plurality of energy generating element arrays in an arrangement direction in which the plurality of energy generating elements are arranged;

at least one temperature detection element group including a plurality of temperature detection elements configured to detect a temperature of the liquid ejection head substrate, that are arranged on one side of the supply port array, and at least one heating element group including a plurality of heating elements configured to heat the liquid ejection head substrate, that are arranged on another side of the supply port array, wherein the number of the at least one temperature detection element group is smaller than the number of the energy generating element arrays and the number of the at least one heating element group is smaller than the number of the energy generating element arrays.

11. A liquid ejection head substrate comprising:

a plurality of energy generating element arrays each including a plurality of energy generating elements configured to generate energy for ejecting liquid;

a supply port array in which a plurality of supply ports configured to supply liquid to the plurality of energy generating elements are arranged between the plurality of energy generating element arrays in an arrangement direction in which the plurality of energy generating elements are arranged;

a temperature detection element group including a plurality of temperature detection elements for detecting a temperature of the liquid ejection head substrate, that are arranged on one side of the supply port array, and a plurality of heating element groups including a plurality of heating elements for heating the liquid ejection head substrate, that are arranged on another side of the supply port array, wherein the heating element groups are provided on two sides of the temperature detection element group.

12. The liquid ejection head substrate according to claim 11, wherein the heating element groups are provided symmetrically about the temperature detection element group.

13. A liquid ejection head comprising:

a liquid ejection head substrate including:

a plurality of energy generating element arrays each including a plurality of energy generating elements configured to generate energy for ejecting liquid;

a supply port array in which a plurality of supply ports configured to supply liquid to the plurality of energy generating elements are arranged between the plurality of energy generating element arrays in an arrangement direction in which the plurality of energy generating elements are arranged;

a temperature detection element that is configured to detect a temperature of the liquid ejection head substrate and that is provided on one side of the supply port array;

a heating element that is configured to heat the liquid ejection head substrate and that is provided on another side of the supply port array, and an ejection port forming member in which an ejection port array including a plurality of ejection ports configured to eject liquid is provided so as to correspond to the energy generating element array, wherein the liquid ejection head substrate is provided in a plurality in the arrangement direction, wherein the liquid ejection head substrates neighboring each other each include an overlapping region where the energy generating elements provided on the respective liquid ejection head substrates overlap and a non-overlapping region where the energy generating elements provided on the respective liquid ejection head substrates do not overlap when viewed in a direction perpendicular to the arrangement direction, and wherein the temperature detection element and the heating element are provided on each of the overlapping regions and each of the non-overlapping regions.

14. The liquid ejection head according to claim 13, wherein the temperature detection element is one of a plurality of temperature detection elements that are arranged on one side of the supply port array in the arrangement direction and that form a temperature detection element group; and wherein the heating element is one of a plurality of heating elements that are arranged on another side of the supply port array in the arrangement direction and that form a heating element group.

15. The liquid ejection head according to claim 14, wherein the heating elements are provided so as to correspond to the respective temperature detection elements.

16. The liquid ejection head according to claim 14, wherein the number of the temperature detection elements forming the temperature detection element group is identical to the number of the heating elements forming the heating element group.

17. The liquid ejection head according to claim 14, further comprising:

switching elements configured to switch driving of the heating elements, wherein the plurality of heating elements forming the heating element group are connected to different switching elements from one another.

* * * * *